United States Patent [19]

Gruner et al.

[11] Patent Number: 4,531,567

[45] Date of Patent: Jul. 30, 1985

[54] INJECTION AND FEEDER PIPE FOR APPARATUS FOR CONTINUOUS CASTING OF STEEL

[75] Inventors: Hans Gruner, Duisburg; Hans Schrewe, Düsseldorf; Fritz-Peter Pleschiutschnigg, Duisburg; Gerd Diederich, Erpel, all of Fed. Rep. of Germany

[73] Assignee: Mannesmann AG, Duesseldorf, Fed. Rep. of Germany

[21] Appl. No.: 448,790

[22] Filed: Dec. 10, 1982

[30] Foreign Application Priority Data

| | | | |
|---|---|---|---|
| Dec. 9, 1981 | [DE] | Fed. Rep. of Germany | 3149399 |
| Feb. 9, 1982 | [DE] | Fed. Rep. of Germany | 3204483 |
| Sep. 22, 1982 | [DE] | Fed. Rep. of Germany | 3235515 |

[51] Int. Cl.[3] ..... B22D 11/10

[52] U.S. Cl. ..... 164/415; 164/437; 222/603

[58] Field of Search ..... 164/415, 475, 437, 488; 222/591, 603

[56] References Cited

U.S. PATENT DOCUMENTS

| | | | |
|---|---|---|---|
| 3,253,307 | 5/1966 | Griffiths et al. | 222/603 X |
| 4,108,339 | 8/1978 | Lunde | 222/603 X |
| 4,203,538 | 5/1980 | Lühresen | 222/603 |
| 4,360,190 | 11/1982 | Ato | 222/603 X |

FOREIGN PATENT DOCUMENTS

| | | | |
|---|---|---|---|
| 54-126631 | 10/1979 | Japan | 164/437 |
| 55-114449 | 9/1980 | Japan | 164/415 |
| 56-102357 | 8/1981 | Japan | 164/437 |
| 396166 | 1/1974 | U.S.S.R. | 164/415 |
| 458382 | 3/1975 | U.S.S.R. | 222/603 |
| 783345 | 11/1980 | U.S.S.R. | 164/437 |

*Primary Examiner*—Nicholas P. Godici
*Assistant Examiner*—J. Reed Batten, Jr.
*Attorney, Agent, or Firm*—Ralf H. Siegemund

[57] ABSTRACT

The particular pipe is provided with a system of blind bores being gas conductively interconnected and an inert gas is fed to this duct and channel system to traverse the gas permeable material of which the pipe is made to emerge particularly from surfaces in contact with molten steel to thereby prevent the precipitation of deposits, particularly on the inside of the pipe, but also on the outside surface thereof where being submerged in the bath of molten steel.

10 Claims, 4 Drawing Figures

INJECTION AND FEEDER PIPE FOR APPARATUS FOR CONTINUOUS CASTING OF STEEL

BACKGROUND OF THE INVENTION

The present invention relates to an injection, feed and charging pipe for machines for continuous casting of steel, the pipe to be made of fireproof refractory, but gas permeable material. Injection or charge pipes of the type to which the invention pertains are usually used for feeding molten steel either from a ladle into a tundish or from the tundish into the mold of the machine and apparatus for continuous casting. The fireproof and refractory material to be used for such a charging and injection pipe, is usually gas permeable. Upon feeding molten steel by means of such a pipe, it has to be observed that particularly in the case of quieted and quiescent steel certain deoxidizing products are precipitated upon the walls of the injection pipe. These deposits reduce the casting throughput and are also detrimental to the quality of the steel product.

DESCRIPTION OF THE INVENTION

It is an object of the present invention to provide a new and improved injection, feeding or charging pipe to be used in an apparatus for continuous casting and to be made of a fireproof refractory and gas-permeable material in which with certainty the deposit of deoxidization products are avoided, particularly within the casting channel, as well as on the outside of the pipe as it dips into the molten steel bath.

In accordance with the preferred embodiment of the present invention, it is suggested that the wall of a pipe to be used as an injection device in an apparatus for continuous casting, is longitudinally traversed by a duct system such as a plurality of blind bores extending around the central axis from the top almost to the bottom of the pipe, these blind bores are interconnected by an annular duct; in addition, a feed duct for an inert gas traverses the wall to lead from the outside to some point of the duct and bore system. Preferably the gas feeder duct leads to the annular channel. In furtherance of the invention, the annular duct is closed vis-a-vis the top proper by means of an insert having a higher wear resistance than the remainder of the pipe. The distance between the end of the blind bore and the lower front end of the pipe's wall should be about half the wall thickness of the pipe.

In order to improve and to render more uniform the effect of the gas, particularly as far as the inner surface of the pipe is concerned it is suggested that the wall thickness between two adjacent blind bores is not larger than twice the wall thickness as between a blind bore and the inner surface of the pipe, preferably the spacing between adjacent blind bores and the radial spacing between a blind bore and the inner surface of the pipe should be equal. It is important, generally, that the gas be uniformly distributed at the surface portions which will be engaged by steel.

Upon continuous casting of steel in form of billets the utilization of such charging and injection pipes produces difficulties in those cases in which the dimensions of the product are relatively small. Small castings are now made occasionally with oil lubrication, i.e. without casting powder or flux and without slag cover. The molten steel discharges from the tundish by means of nozzles which are prone to clogging, particularly because the surface in relation to the cross-section is rather large. Therefore, casting of aluminum quieted steel is not possible because the nozzles would clog in a very short period of time. Thus, it was customary in the past to quiet the steel by means of silicon or manganese. Oil lubrication is of advantage because a charge and injection pipe of a conventional design does not have to be used, it is simply too large, particularly in view of the fact that the rate of deposit during casting and the total thickness of a resulting deposit to be expected during a run has to be taken into consideration upon designing the cross section and other dimensions of the injection and charging pipe. In the case of very small charging pipes, there are problems moreover resulting from the fact that during startup, the steel may "freeze" in view of the small dimensions involved.

The invention however provides a feeding, injection and charge pipe which avoids deposits by operation of the gas injection into the pipe. Even in the case of aluminum quieted steel deposits on and in the pipe are in fact avoided. Therefore, the particular type of feeding and injection pipes as per the invention can even be used for casting billets being smaller or equal to 130 millimeters. This in turn permits avoidance of oil lubrication and instead casting powder and flux can be used, which of course improves the surface quality to a considerable extent.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof, will be better understood from the following description taken in connection with the accompanying drawings in which:

DETAILED DESCRIPTION OF THE PREFERRED EMBODIMENTS

Figure 1:
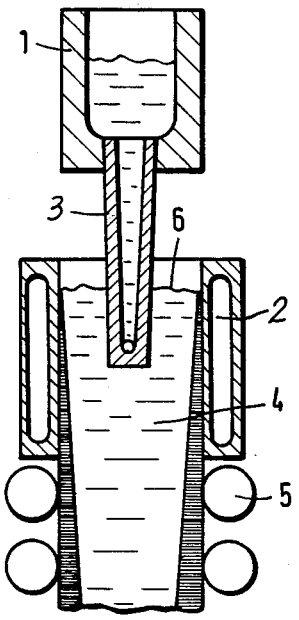
Fig.1 PRIOR ART
FIG. 1 is an overall cross-section view of a device and apparatus for continuous casting.

FIG. 1 illustrates somewhat schematically a machine and apparatus for continuous casting having a casting vessel 1 which may be a ladle or a tundish and a casting, discharge or injection pipe 3 leading from the bottom of the vessel 1 into the interior of a mold 2 for continuous casting. The mold is provided with the usual cooling ducts and passages. Reference numeral 4 refers to the casting as it is being produced by this mold 2, and one can see that a barely solidified skin enclosing a molten interior emerges from the bottom of the mold to be moved further by means of a roller track 5. The bottom of the casting pipe 3 is submerged in the molten steel, i.e. it extends below the surface level 6 of the bath therein.

Figure 2:
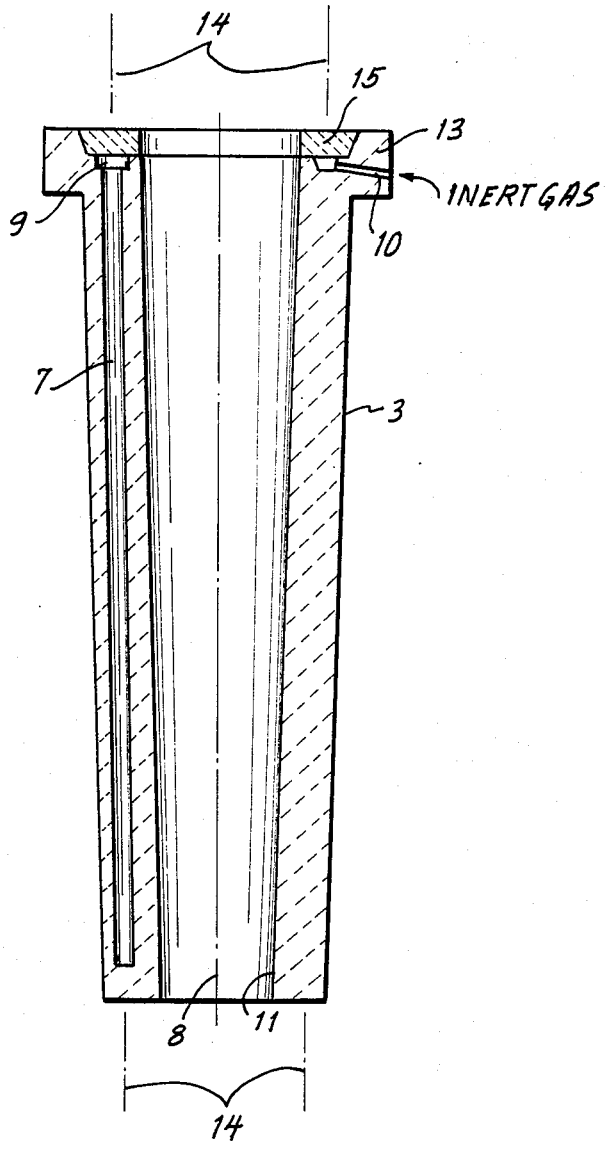
FIG. 2 is a longitudinal section view through a feeder, injection and charge pipe in accordance with the preferred embodiment of the present invention for practicing the best mode thereof and particularly adapted for being affixed to the bottom of a vessel.

After having described generally the background and equipment in which the invention is practiced, we refer now to FIG. 2 illustrating a particular pipe 3 constructed in accordance with the preferred embodiment of the present invention. The pipe 3 is comprised of fireproof refractory and gas permeable material e.g. a porous ceramic. The pipe is slightly tapered and has a slighted tapered interior around an axis 8 and an inner wall surface 11. The wall of the pipe 3 is traversed by a plurality of longitudinally extending blind bores 7. These bores 7 are arranged concentrically around the axis 8 of the pipe and traverse the wall accordingly. The blind bores or ducts 7 extend from the top to almost the bottom of the pipe, i.e. they end a little ahead of the lower front face of the pipe 3 at a spacing which is about half the thickness of the wall of the pipe.

The several blind bores 7 are interconnected near the top of the pipe by means of a flat annular duct or channel 9. The channel 9 is worked as an annular groove into the pipe material and the duct or channel 9 is closed from the top by means of a fireproof insert 15 having a higher wear resistance than the material of which the pipe 3 is made. In addition, the pipe 3 is provided with a flange 13 by means of which the pipe can be affixed to the bottom of a ladle or tundish.

The flange 13 particularly is, in addition, traversed by a narrow duct 10 leading from the outside to the annular channel 9. That duct 10 is connected to a source of inert gas supplying therefore inert gas to the annular channel 9 as well serving as a manifold or distributor to feed all of the blind bores 7. In view of the fact that the material of which the pipe 3 is made is gas permeable (porous), that gas will in fact migrate or even be forced through the tube material and emerge on the outside, that is the inside of the tube 3 and the bottom and the outside surface thereof.

Figure 3:
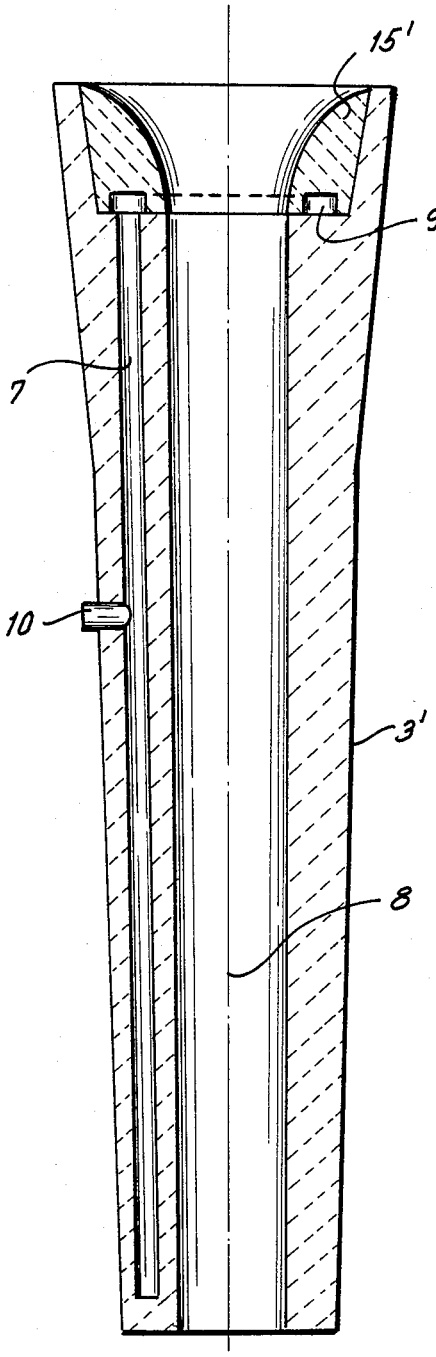
FIG. 3 is another example for the preferred embodiment of the present invention also shown in longitudinal section and constructed for being inserted into an opening in the bottom of a vessel from which steel is to be discharged.

FIG. 3 illustrates a somewhat modified pipe 3' having again the same system of ducts 7 and an annular interconnect channel 9. However, the upper portion of this pipe 3' is more strongly tapered for insertion into an opening in a bottom of the vessel from which molten steel is to be poured. Also, the particular duct and channel 9 is closed by means of an insert 15' made also of wear resisting fireproof and refractory material, but having a trumpet shaped inlet. Moreover, one can see that in this particular case, the annular channel is established by an annular groove in the insert 15 and a certain bottom portion of an opening in the pipe 3 serves in this case as a bottom for this channel 9 from which the blind bores 7 extend in down direction. Moreover, in the particular pipe shown in FIG. 3, the gas duct 10 leads into one of the blind bores 7. The reason being that in the case of inserting this pipe 3' into the bottom structure of the casting ladle or tundish there may be no direct access to the annular channel 9.

In the case of making such a pipe, one may provide originally these blind bores by means of cores made of a material such that upon sintering the refractory material, these cores melt and flow out or burnoff.

The two pipes illustrated in FIGS. 2 and 3 are shown to be of integral construction, with the exception of course of the top insert. In the alternative, however, one may construct such a feed and injection pipe of either configuration by means of two pipes arranged concentric to each other i.e. in a nested configuration and each of these two pipes has a system of grooves, the inner one of the two pipes on the outside surface and the outer one of the two pipes on its inside surface. These grooves in pairs complete such blind bores as illustrated. The tapered surface 14 denotes geometrically the partitioning of pipe 3 into two such nested pipes.

As stated, it is the purpose of the inventive bore and duct system to feed gas on a continuous basis into the pipe and the gas is to traverse the wall material. This effect, however, is not needed, and from a point of view of economy and gas consumption is actually undesired as far as that outer surface portion of the pipe is concerned which extends between the casting vessel 1 and the bath level 6. Therefore, the outer surface of the pipe in that range may be covered with a material which is impermeable to gas so that the gas flow is restricted to a flow resulting in an emergence from the inside surface of the pipe as well as from the lower outside surface thereof.

In general, it was found that the pipe in accordance with the present invention avoids successfully the depositing and precipitation of deoxidizing products on the inside surface of the pipe as well as on that portion of the outside surface which dips into the molten steel. It should further be mentioned, that the conventional feed, injection and discharge pipe exhibits precipitation deposits on the outer surface which in fact can directly interfere with the formation of the solidified skin of the casting inside of the mold. This, of course, is a considerable danger and the inventive pipe avoids this problem with certainty. Moreover, in those case in which the bath is covered with a casting slag the continuous emergence of the inert gas avoids that attack of the pipe by the slag.

Figure 4:
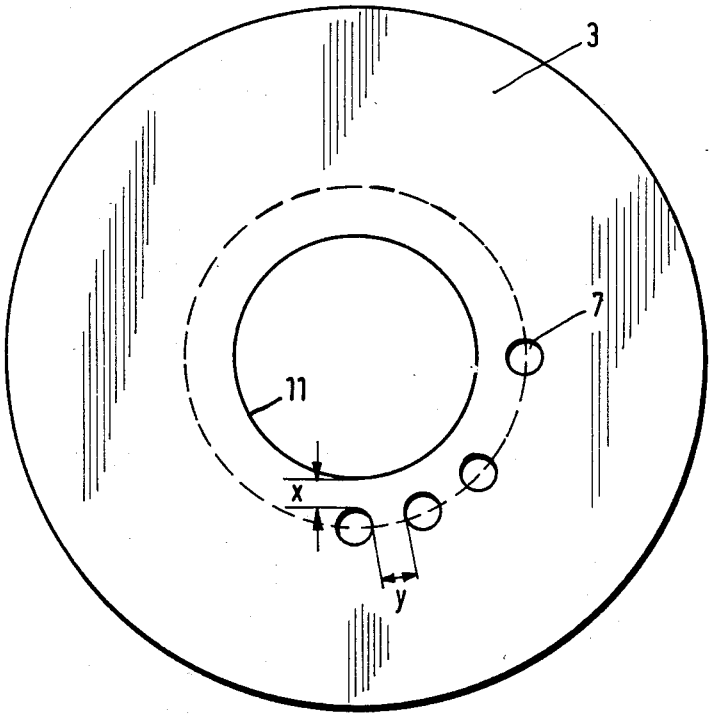
FIG. 4 is a cross-section through a pipe in accordance with the preferred embodiment of the present invention following in particular rules for dimensioning.

Finally, it should be pointed to FIG. 4 which shows a preferred dimensioning and proportioning of the blind bores in the wall of the pipe. As stated the various blind bores are arranged concentrically around the axis of the pipe. Character x denotes the radial spacing between such a bore 7 and the inner surface 11 of the pipe. The character y denotes the azimuthal spacing between two adjacent bores 7. In a preferred form of practicing the invention, these two dimensions x and y are equal. However, generally speaking, the spacing y should not exceed twice the spacing x.

The invention is not limited to the embodiments described above, but all changes and modifications thereof, not constituting departures from the spirit and scope of the invention are intended to be included.

We claim:

1. In an apparatus for continuous casting of steel, a feeding and injection pipe of fireproof refractory and gas permeable material comprising:

a pipe body having a wall of particular thickness;

a plurality of blind bores longitudinally traversing said wall and arranged concentrically around the axis of the pipe;

an annular channel gas conductively interconnecting said blind bores;

means for closing said blind bores at one end of the pipe body; and a duct for feeding an inert gas from the outside to the system of bores and channel.

2. A pipe in accordance with claim 1 wherein said gas duct leads to said annular channel.

3. A pipe as in claim 1 wherein said means for closing includes an insert of a material having a higher wear resistance than the material of which said pipe is made, said insert constituting a boundary for said annular channel.

4. A pipe as in claim 1 wherein said pipe is of uniform construction except for said means for closing.

5. A pipe as in claim 1 wherein said pipe is made of two concentrically arranged pipes, said blind bores being constituted by grooves in interfacing surfaces of said pipes.

6. A pipe as in claim 1 wherein said blind bores end at a distance from a bottom face of said pipe, said distance being about equal to half the wall thickness of said pipe at said end.

7. A pipe as in claim 1 wherein the pipe is porous so that gas fed into the blind bores will penetrate the wall in surface portions being in contact with molten steel so as to prevent precipitation on said surface portions on the inside and the outside of the pipe.

8. A pipe as in claim 1 wherein said blind bores end at a distance from a bottom face of said pipe, said distance being about equal to half the wall thickness of said pipe at said end, and said bores are spaced from each other by a distance not exceeding the spacing of a blind bore from the inside surface of the pipe.

9. A pipe as in claim 1 wherein said blind bores are spaced from each other by a distance not exceeding the spacing of a blind bore from the inside surface of the pipe.

10. A pipe in accordance with claim 9 wherein said two spacings are equal.

* * * * *